United States Patent [19]

Lessard et al.

[11] Patent Number: 5,036,634

[45] Date of Patent: Aug. 6, 1991

[54] KNOCK DOWN SHELTER AND STORAGE STRUCTURE

[76] Inventors: Ronald R. Lessard, 576 Sabattus St.; Gregory F. Russell, P.O. Box 7003, 2 Cottage Rd., both of Lewiston, Me. 04240

[21] Appl. No.: 522,641

[22] Filed: May 14, 1990

[51] Int. Cl.[5] ..... E04H 1/12

[52] U.S. Cl. ..... 52/79.1; 52/282; 52/264; 446/105; 446/106

[58] Field of Search ..... 52/70, 79.1, 79.2, 79.5, 52/90, 92, 233, 234, 281, 282; 446/105, 106, 110

[56] References Cited

U.S. PATENT DOCUMENTS

| | | | |
|---|---|---|---|
| 696,996 | 4/1902 | Mott | 52/282 X |
| 1,150,363 | 8/1915 | Haskins . | |
| 2,059,598 | 11/1936 | Paulson | 446/106 |
| 2,099,075 | 11/1937 | Paulson | 446/110 X |
| 2,143,667 | 1/1939 | Troiel . | |
| 2,422,217 | 6/1947 | Barnes | 446/106 |
| 2,615,209 | 10/1952 | Radart | 52/70 |
| 2,717,429 | 9/1955 | Nead . | |
| 3,137,967 | 6/1964 | Flieth | 446/105 X |
| 3,228,137 | 1/1966 | Runser . | |
| 3,571,965 | 3/1971 | Gibb | 446/105 |
| 4,003,167 | 1/1977 | Saunders . | |
| 4,089,144 | 5/1978 | Astl | 52/281 |
| 4,270,302 | 6/1981 | Dandia . | |
| 4,270,304 | 6/1981 | Sofer . | |

FOREIGN PATENT DOCUMENTS

| | | | |
|---|---|---|---|
| 848772 | 7/1949 | Fed. Rep. of Germany | 446/106 |

*Primary Examiner*—David A. Scherbel
*Assistant Examiner*—Kien T. Nguyen
*Attorney, Agent, or Firm*—Auslander & Thomas

[57] ABSTRACT

The knock down shelter and storage structure of the present invention includes a base frame assembly formed by interlocking beams. A vertical wall assembly engages the base frame and includes a plurality of corner uprights. A plurality of intermediate uprights and plurality of wall panels slidably engage the uprights to form an enclosed structure. A roof assembly is formed from a plurality of rafters and a plurality of roof panels that slidably engage the rafters. The roof assembly includes transverse members at the forward and rearward portions of the rafters. The assembly forms a rigid known down structure.

14 Claims, 4 Drawing Sheets

FIG.5
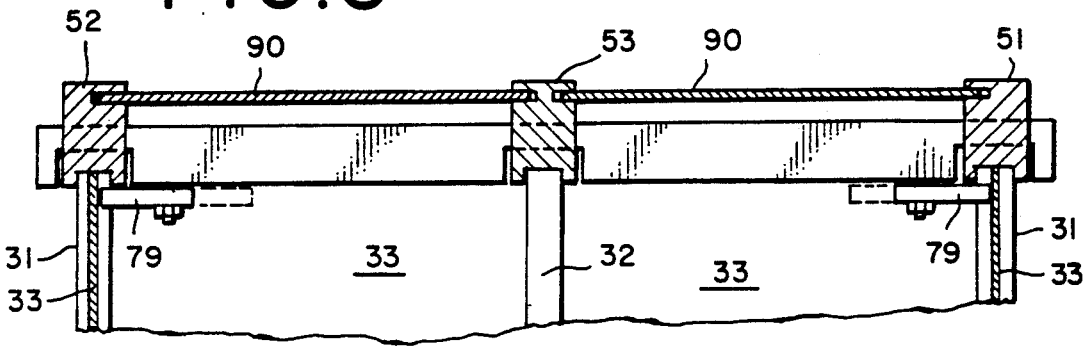
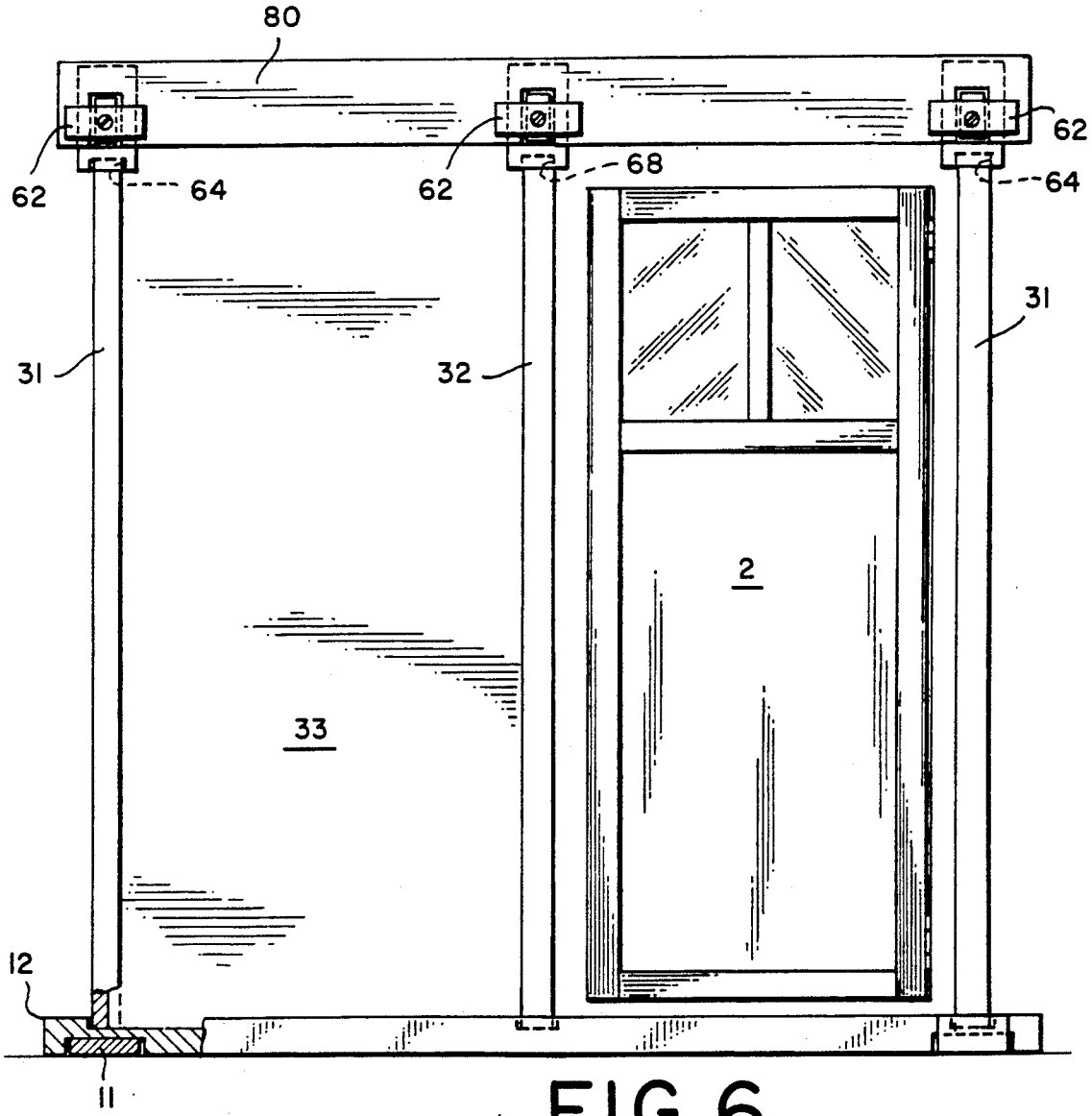
FIG.6

KNOCK DOWN SHELTER AND STORAGE STRUCTURE

BACKGROUND OF THE INVENTION

The present invention relates to portable building structures suitable for shelter or secure storage that can be assembled without the use of tools or nails, screws and the like to form a rigid structure and that can be readily dismantled.

Portable building structures that can be readily assembled and dismantled are generally referred to as "knock down structures." These structures are used as temporary enclosures to shelter the user while hunting or fishing, for example, or as vacation cabins and recreational shelters for the home. A particular problem with "knock down structures" is providing a sufficiently rigid structure that can resist high winds and inclement weather while retaining its characteristic of being easily assembled and dismantled. In the prior art structures, rigidity has been increased by providing structural frame members having metallic joint supports, dowel pin connectors and interlocking slots or by fixedly attaching structure support posts to the ground or concrete slab upon which the structure is assembled. The limitations of a knock down structure that is fixedly attached on site to the supporting ground or slab can be readily understood. Portable building structures that utilize metallic joint supports and dowel pins to increase rigidity generally require the use of tools and a large plurality of such supports and pins to assure the construction of a knock down structure that will resist high winds and inclement weather. Thus there remains a need for a knock down building structure of sufficient rigidity to resist adverse environmental elements that can be readily assembled and dismantled without the use of tools and fastener means.

DESCRIPTION OF THE RELATED ART

The prior art most closely related to the present invention is generally included in two categories: (1) portable enclosures, and (2) toy building blocks.

U.S. Pat. No. 2,615,209 to Radart discloses a portable enclosure formed by hingedly attached vertical walls rigidly secured by detachable fastener means.

U.S. Pat. No. 2,717,429 to Nead discloses a knock down shelter type structure having two fixedly attached wall panels disposed at right angles to each other and two rotating wall panels hingedly attached to the respective free vertical edges of each fixedly attached wall panel. The wall panels of the Nead invention are supported by vertically extending posts which are fixedly attached to the ground or concrete slab on which the structure is assembled.

U.S. Pat. No. 4,003,167 to Saunders discloses a prefabricated cabin construction having its walls formed by bolting together plywood panels in overlapping engagement between corner strengthening strips and a roof support assembly formed by interfitting a plurality of rafters disposed at right angles with each other and with the top edge of the overlapping portions of the wall panels for receipt of a flexible roofing material.

Toy building blocks have long been known in the art. In U.S. Pat. No. 1,150,363 to Haskins there is disclosed interlocking toy building blocks including a rectangular, substantially thin plank member having a groove formed along the mid-portion of its narrow edges and a substantially rectangular block having outwardly projecting tenons on each face of the rectangular block which selectively engage the groove of the plank member.

U.S. Pat. No. 2,143,667 to Troiel discloses building blocks slotted for receipt of connecting members having flat metallic tension members and right angled clip members insertable in aligned slots of two or more adjacent blocks.

U.S Pat. No. 3,228,137 to Runser discloses toy building blocks including a block having intercrossing slots formed on a flat end of the block and a block having a slot formed on a beveled end of the block, or a combination thereof.

U.S. Pat. No. 4,270,304 to Sofer discloses flush-fitting toy building blocks comprising a plurality of rectangularly-shaped prismatic bars having notches cut into the sides of the bars which selectively interlock to form various building structures.

Knock down toy houses have also been shown in the prior art. Exemplary of this construction is U.S. Pat. No. 2,714,782 to Dinn where overlapping siding sections are secured to the walls of the structure by inclined pegs disposed at corner uprights of the walls. The Dinn invention also discloses peg attachment of the roof and floor to the walls of the structure.

U.S. Pat. No. 3,571,965 to Gibb discloses a toy house that includes corner uprights and interior uprights having slots formed in opposing faces of the respective uprights and dowel receiving openings formed in the slots which provide dowel support of a plurality of panels insertable in the slots of the uprights.

U.S. Pat. No. 4,270,302 to Dandia discloses a toy building construction set that includes a planar floor board having an array of apertures disposed on the surface of the board, a plurality of slotted uprights of varying cross-section which at one end engage the apertures of the floor board, a plurality of panels which engage the slots of the uprights to form walls, and a roof structure which rests upon the top end of the uprights.

While the toy building blocks and toy houses of the prior art show various modules for knock down structures, these structures do not generally include construction means that provide sufficient rigidity to resist high winds and inclement weather, since their purpose is directed to providing structural means for entertaining and developing creativity rather than providing shelter or secure storage.

SUMMARY OF THE INVENTION

The present invention is a knock down shelter and storage structure that includes a base frame assembly, a vertical wall assembly and a roof assembly.

The base frame assembly forms a generally rectangular base by the interlocking at right angles of a pair of first base beams and a pair of second base beams. Each first base beam is an elongated member having a substantially rectangular cross-section. First and second end notches are transversely cut in the upper face of the first base beams. The second base beams are similarly-shaped elongated members having first and second end notches transversely cut in the lower face of the second base beams. The notches of the first base beams interlock with the notches of the second base beams to form the rectangular base for the structure of the present invention.

The first base beams further include one or a plurality of intermediate cavities formed in its upper face between the respective end notches and longitudinal grooves extending from the respective first beam end notches to the first beam intermediate cavities and thereinbetween. The second base beams include first and second rectangular end cavities and one or a plurality of intermediate cavities formed in the upper face of the second base beam. The end cavities and intermediate cavities are preferably rectangular. Longitudinal grooves extend from the respective second beam end cavities to the second beam intermediate cavity. The second base beam further includes transverse grooves formed in its upper face which extend from one side of the respective second beam end cavities to the side edge of the second base beams at a right angle to the longitudinal groove of the second base beam. When the pair of first base beams and the pair of second base beams are interlocked by engaging the respective end notches, the transverse grooves of the second base beams align with longitudinal grooves of the second base beams.

The vertical wall assembly of the present invention includes a plurality of vertically-extending corner uprights, a plurality of vertically-extending intermediate uprights, and a plurality of generally rectangular wall panels. The corner uprights respectively engage the first and second end cavities of the second base beam at the lower end thereof and engage the roof assembly at the upper end thereof. The intermediate uprights respectively engage the intermediate cavities of the first base beams and the second base beams at the lower end thereof and engage the roof assembly at the upper end thereof. The corner uprights are elongated beams preferably having a substantially rectangular cross-section and include longitudinal grooves extending for the length of the uprights formed in adjacent faces of the corner upright, thereby providing grooved faces at right angles to each other. The corner uprights are sized to fit in close engagement within the end cavities of the second base beams. The intermediate uprights are elongated beams preferably having a substantially rectangular cross-section of a size to fit in close engagement within the intermediate cavities of the first and second base beams. The intermediate uprights include longitudinal grooves extending for their length formed in opposing faces of the intermediate uprights. The wall panels slidably engage the longitudinal grooves of the corner uprights and the intermediate uprights, and the respective longitudinal and transverse grooves of the first base beam and the second base beam to form an enclosed structure.

The roof assembly includes a first end rafter, a second end rafter, one or a plurality of intermediate rafters, a rafter cross beam which transversely engages the rearward ends of the first end rafter, second end rafter and intermediate rafters, a rafter locking bar which transversely engages the forward ends of the first end rafter, the second end rafter and the intermediate rafters, and a plurality of generally rectangular roof panels which slidably engage the first end rafter, the second end rafter and the intermediate rafters. The respective end rafters are prismatic members having a top face that slopes downwardly from front to rear, vertically-extending side faces and a substantially flat lower face. A rafter rear end block is integrally formed or fixedly attached at the rearward face of each end rafter. The rafter rear end block extends for a greater height than the lower end of the sloping top face of the respective end rafter and extends for a greater width than the vertical side faces of the respective end rafter. A cross beam notch is formed in the top face of the respective end rafters adjacent to the inward face of the end block for receipt of the cross beam in transverse engagement. A rafter front end block is integrally formed or fixedly attached at the forward face of each end rafter. The rafter front end block extends for a lesser height that the higher end of the sloping top face and extends for a lesser width than the vertical side faces of the respective end rafters. Roof locking means are rotatably attached to the forward face of the respective rafter front end blocks. The roof locking means rigidly secure the roof assembly by engaging the locking means in bearing relationship with the rafter locking bar. A longitudinal groove extends along the inwardly-disposed side face of the end rafter at the same slope as the top face of the rafter. The end rafter side face groove extends form the forward face of the end rafter to the cross beam notch. The bottom surfaces of the end rafter side face groove and the cross beam notch coincide. The bottom face of the end rafters includes an end rafter forward notch, an end rafter rearward notch and one or a plurality of end rafter intermediate notches. The end rafter notches transversely cut an inward portion of the bottom face of the end rafters. The upper end of the corner uprights of the vertical wall assembly engage the respective forward and rearward notches of the end rafters. The upper end of the intermediate uprights engage the end rafter intermediate notches.

The intermediate end rafters of the roof assembly are formed substantially the same as the respective end rafters with the following differences. Instead of a single longitudinal groove being formed on the inward face of the rafter as described for the end rafter, paired longitudinal grooves extend along each side face of the intermediate rafter at the same slope as the top face of the intermediate rafter. No intermediate notches are provided in the bottom face of the intermediate rafter and the forward and rearward notches of the intermediate rafter transversely cut completely across the bottom face of the intermediate rafters. In all other respects the intermediate rafter is formed as heretofore described for the end rafters.

The rafter cross beam is substantially an elongated rectangular plank member having its wide portion disposed substantially horizontally and having end cross beam blocks integrally formed or fixedly attached at the respective ends of the elongated plank member. A first cross beam notch, a second cross beam notch and one or a plurality of intermediate cross beam notches are respectively formed on the lower side of the plank member by fixedly attached first, second and intermediate L-shaped notch blocks. The notch blocks are disposed in spaced relationship below the plank member by means of a notch block spacer. The notch block spacer is flush with the rearward side of the plank member and is narrower than the plank member and extends a shorter distance forwardly than the notch block and thereby forms a slot between the plank member and the notch block. The respective notch blocks are disposed flush with the rearward side face of the plank member and extend forwardly beyond the width of the plank member with the foot of the L-shaped block extending downwardly. Cross beam locking means are rotatably attached to the toe of the notch blocks.

The locking bar is substantially an elongated rectangular plank member having its wide portion disposed vertically. The locking bar includes slots disposed in its lower portion corresponding in number to the total number of end rafters and intermediate rafters. The slots of the locking bar engage the rafter front end blocks of the end rafters and the intermediate rafters in a close fit. The rotatable locking means at the rafter front end blocks selectively bear against the locking bar when rotated.

The roof panels slidably engage the longitudinal grooves of the rafters and the slots located above the notch blocks and are inserted therein before attaching the locking bar. The locking bar thereby facilitates rigid attachment of the roof panels when secured in place by operation of the front locking means.

A substantially rigid structure has been heretofore described which can readily be assembled and dismantled on site without the use of any tools. Although the novel feature or features believed to be characteristic of the invention are pointed out in the claims, the invention and the manner in which it may be carried, may be further understood by reference to the following description of a preferred embodiment and the accompanying drawings.

BRIEF DESCRIPTION OF THE DRAWINGS

FIG. 5 is a fragmented rear plan view of the roof assembly.

FIG. 6 is a front plan view of the knock down structure of the present invention.

DETAILED DESCRIPTION OF A PREFERRED EMBODIMENT

Reference is now made to the figures which illustrate in greater detail the present invention, where like reference numbers denote like parts in the various figures.

Figure 1:
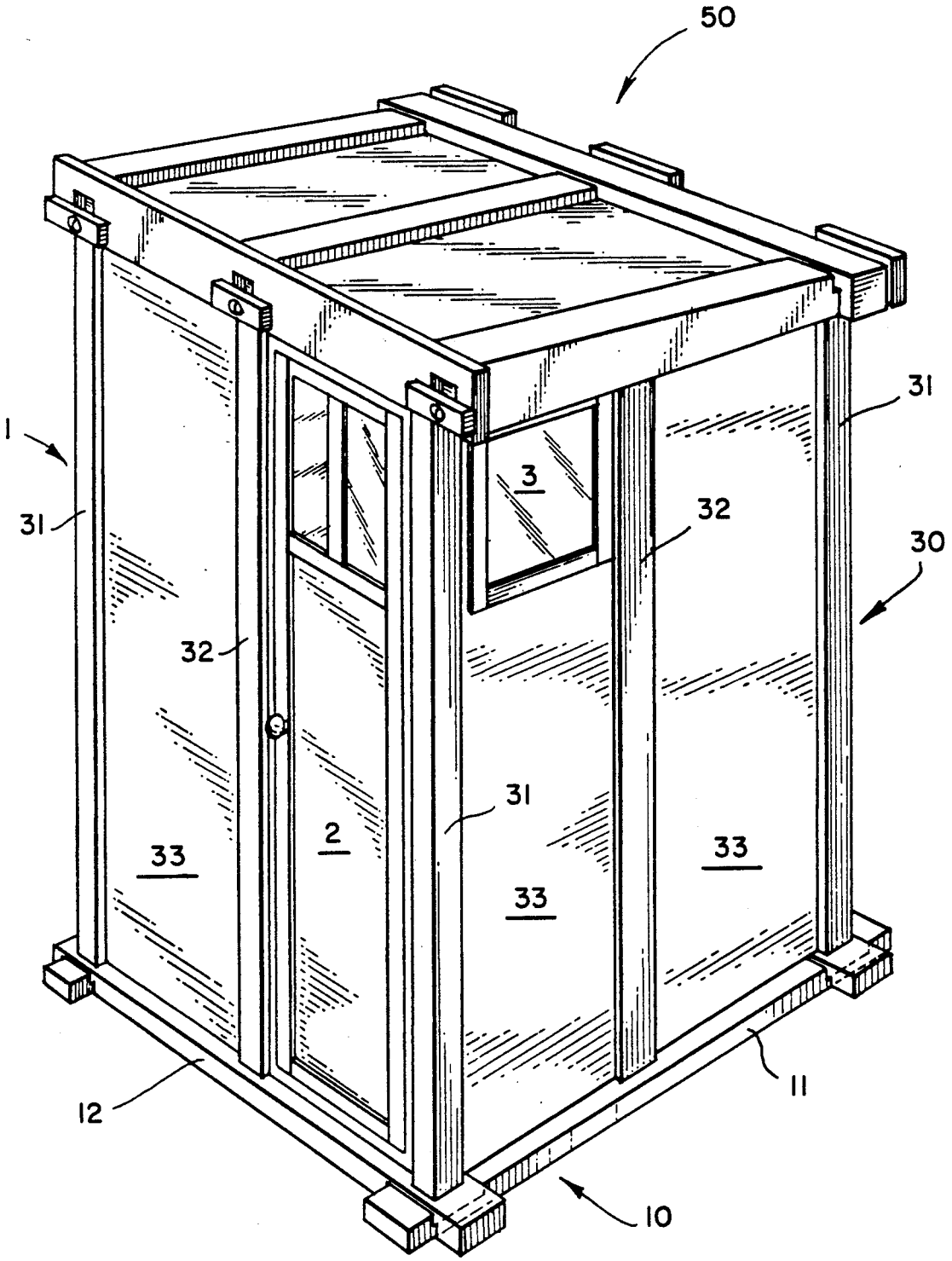
FIG. 1 is a perspective view of the knock down structure of the present invention shown assembled.

The knock down shelter and storage structure 1 of the present invention is shown assembled in FIG. 1. The structure 1 includes a base frame assembly 10, a vertical wall assembly 30 and a roof assembly 50. The base frame assembly 10 provides bearing support for the vertical wall assembly 30 and roof assembly 50 of the structure 1.

Figure 2:
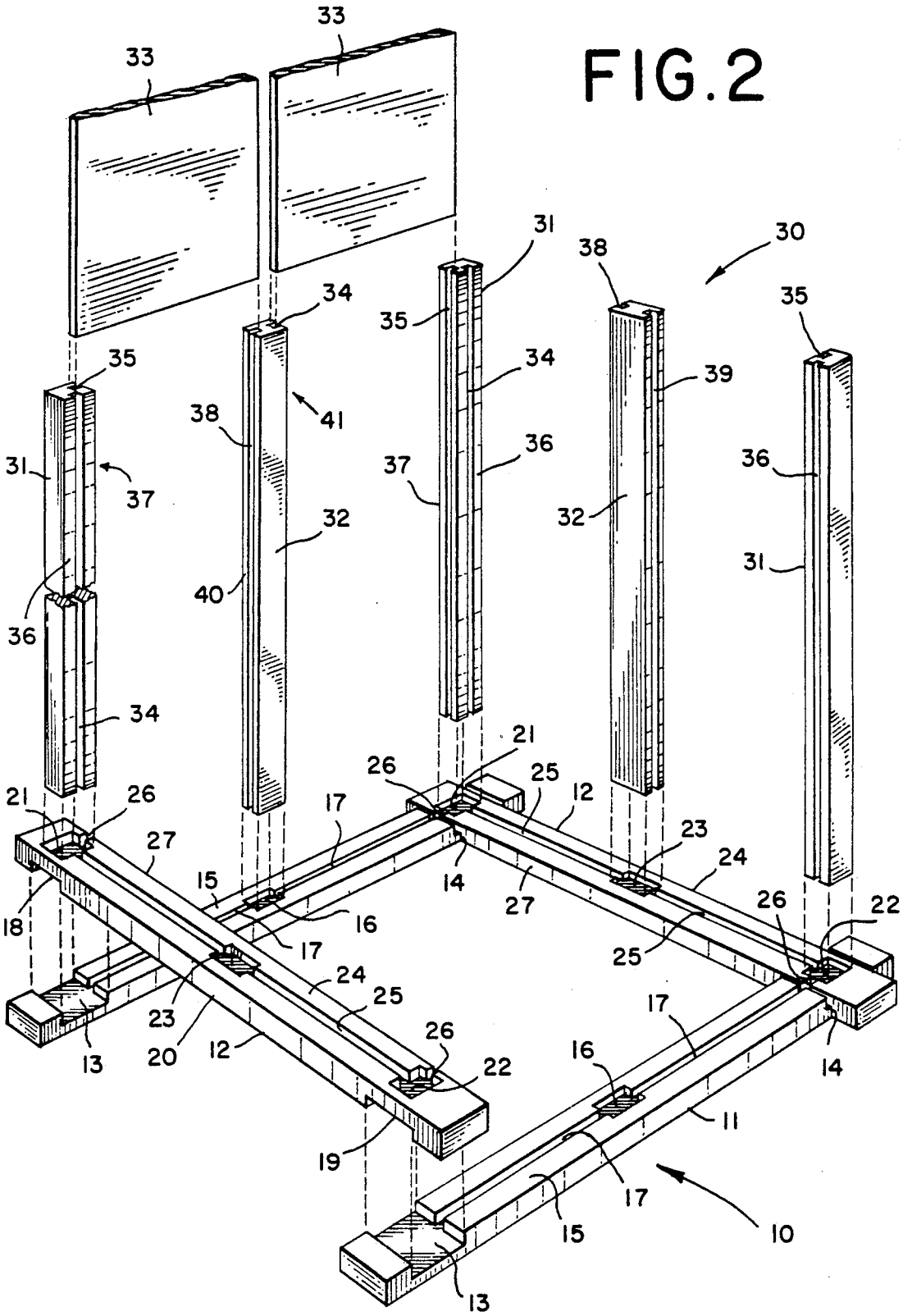
FIG. 2 is an exploded perspective view of the base frame assembly and the vertical wall assembly.

As can be seen in FIG. 2, base frame assembly 10 forms a generally rectangular bearing support by the interlocking at right angles of a pair of first base beams 11 and a pair of second base beams 12. Each first base beam 11 is an elongated member having a substantially rectangular cross-section First end notches 13 and second end notches 14 are transversely cut in the upper face 15 of the first base beams 11. The first base beams 11 further include one or a plurality of intermediate cavities 16 formed in the upper face 15 between the respective end notches 13, 14, a single cavity 16 being shown in the preferred embodiment for illustration purposes only. Longitudinal grooves 17 extend from the respective first beam end notches 13, 14 to the first beam intermediate cavities 16 and thereinbetween (when the first base beam 11 includes a plurality of intermediate cavities 16; not shown).

The second base beams 12 are similarly-shaped elongated members having first end notches 18 and second end notches 19 transversely cut in the lower face 20 of the second base beams 12. The second base beams 12 include a first end cavity 21, a second end cavity 22 and one or a plurality of intermediate cavities 23 formed in the upper face 24 of the second base beam 12. The end cavities 21, 22 and intermediate cavities 23 are preferably rectangular. Longitudinal grooves 25 extend between the respective second beam end cavities 21, 22 and the second beam intermediate cavity 23. The second base beam 12 further includes short transverse grooves 26 formed in its upper face 24 which extend from one side of the respective second beam end cavities 21, 22 to the inward side edge 27 of the second base beams 12 at a right angle to the longitudinal grooves 25 of the second base beams 12.

The notches 13, 14 of the first base beams 11 interlock with the notches 18, 19 of the second base beams 12 to form the rectangular base for the structure 1, the end notches 18, 19 of one second base beam 12 engaging the first end notches 13 of the respective first base beams 11 and the end notches 18, 19 of the other second base beam 12 engaging the second end notches 14 of the respective first base beams 11. When the pair of first base beams 11 and the pair of second base beams 12 are interlocked by engaging the respective end notches 13, 14 and 18, 19, the transverse grooves 26 of the second base beams 12 align with longitudinal grooves 17 of the first base beams 11.

FIG. 2 also illustrates the basic components of the vertical wall assembly 30. Vertical wall assembly 30 includes a plurality of vertically-extending corner uprights 31, a plurality of vertically-extending intermediate uprights 32, and a plurality of generally rectangular wall panels 33. The corner uprights 31 respectively engage the first and second end cavities 21, 22 of the second base beam 12 at the lower end thereof and engage the roof assembly 50 at the upper end thereof (FIG. 1). The intermediate uprights 32 respectively engage the intermediate cavities 16 of the first base beams 11 and the intermediate cavities 23 of the second base beams 12 at the lower end thereof and engage the roof assembly 50 at the upper end thereof (FIG. 1). The corner uprights 31 are elongated beams preferably having a substantially rectangular cross-section and include longitudinal grooves 34, 35 extending for the length of the member in adjacent faces 36, 37 of the corner uprights 31, thereby providing grooved faces 36, 37 at right angles to each other. The corner uprights 3]are sized to fit in close engagement within the end cavities 21, 22 of the second base beams 12. The intermediate uprights 32 are elongated beams preferably having a substantially rectangular cross-section of a size to fit in close engagement within the intermediate cavities 16, 23 of the first and second base beams 11, 12. The intermediate uprights 32 include longitudinal grooves 38, 39 extending for the length of the member in opposing faces 40, 41 of the intermediate uprights 32.

The wall panels 33 slidably engage the longitudinal grooves 34, 35 and 38, 39 of the corner uprights 31 and the intermediate uprights 32, and the respective longitudinal grooves 17, 25 and transverse grooves 26 of the first base beam 11 and the second base beam 12 to form an enclosed structure 1. As can be seen by now referring to FIG. 1 the wall panels 33 may be formed to include a swinging door 2 or a window 3.

Figures 3, 4:
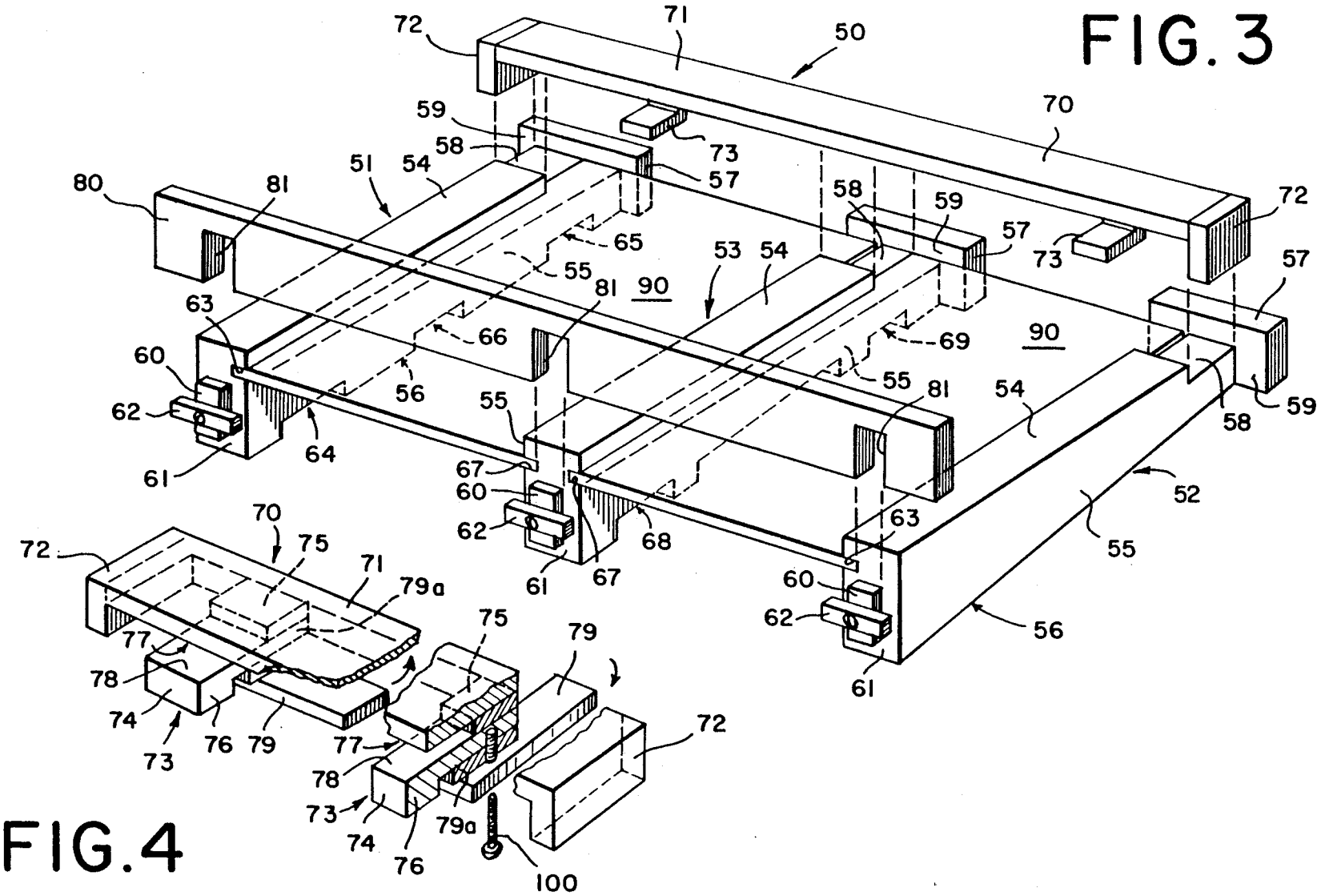
FIG. 3 is a perspective view of the roof assembly shown partially exploded.
FIG. 4 is a partially-fragmented view of the rafter cross beam and cross beam locking means of the roof assembly.

As can be seen in FIG. 3, roof assembly 50 includes a first end rafter 51, a second end rafter 52, one or a plurality of intermediate rafters 53, a rafter cross beam 70 which transversely engages the rearward ends of the first end rafter 51, second end rafter 52 and intermediate rafters 53, a locking bar or facer board 80 which transversely engages the forward ends of the first end rafter 51, the second end rafter 52 and the intermediate rafters 53, and a plurality of generally rectangular roof panels 90 which slidably engage the first end rafter 51, the second end rafter 52 and the intermediate rafters 53. The respective end rafters 51, 52 are prismatic members having a top face 54 that slopes downwardly from front to rear, vertically-extending side faces 55 and a substantially flat bottom face 56. A rafter rear end block 57 is integrally formed or fixedly attached at the rearward face of each end rafter 51, 52. The rafter rear end block 57 extends for a greater height than the lower end of the sloping top face 54 of the respective end rafter 51, 52 and extends for a greater width than the vertical side faces 55 of the respective end rafter 51, 52. A cross beam notch 58 is formed in the top face 54 of the respective end rafters 51, 52 adjacent to the inward face 59 of the end block for receipt of the cross beam 70 in transverse engagement. A rafter front end block 60 is integrally formed or fixedly attached at the forward face 61 of each end rafter 51, 52. The rafter front end block 60 extends for a lesser height that the higher end of the sloping top face 54 and extends for a lesser width than the vertical side faces 55 of the respective end rafters 51, 52. Roof panel locking means 62 are rotatably attached to the forward face of the respective rafter front end blocks 60. The roof panel locking means 62 rigidly secure the roof panels 90 by engagement of the locking means 62 in bearing relationship with the rafter locking bar or facer board 80 as hereinafter described in greater detail.

A longitudinal groove 63 extends along the inwardly-disposed side face 55 of the end rafter 51, 52 at the same slope as the top face 54 of the rafter 51, 52. The end rafter side face groove 63 extends from the forward face 61 of the end rafter 51, 52 to the cross beam notch 58. The bottom surfaces of the end rafter side face groove 63 and the cross beam notch 58 coincide. The bottom face 56 of the end rafters 51, 52 includes an end rafter forward notch 64, an end rafter rearward notch 65 and one or a plurality of end rafter intermediate notches 66. The end rafter notches 64, 65, 66 transversely cut an inward portion of the bottom face of the end rafters 51, 52. The upper end of the corner uprights 31 of the vertical wall assembly 30 (FIG. 2) engage the respective forward 64 and rearward notches 65 of the end rafters 51, 52. The upper end of the intermediate uprights 32 engage the end rafter intermediate notches 66.

Intermediate rafters 53 of the roof assembly 50 are formed substantially the same as the respective end rafters 51, 52 with the following differences. In the intermediate rafter 53 instead of a single longitudinal groove 63 being formed on the inward side face 55 as described for the end rafters 51, 52, paired longitudinal grooves 67 extend along each side face 55 of the intermediate rafter 53 at the same slope as the top face 54 of the intermediate rafter 53. No intermediate notches 66 are provided in the bottom face 56 of the intermediate rafter 53 and the forward and rearward notches 68, 69 of the intermediate rafter 53 transversely cut completely across the bottom face 56 of the intermediate rafters 53. In all other respects the intermediate rafter 53 is formed as heretofore described for the end rafters 51, 52 and the parts of the intermediate rafter 53 that are the same as described for the end rafters 51, 52 are denoted by like numerals.

The facer board 80 is substantially an elongated rectangular plank member having its wide portion disposed vertically. Facer board 80 includes vertical slots 81 disposed in its lower portion corresponding in number to the total number of end rafters 51, 52 and intermediate rafters 53. The vertical slots 81 of the facer board 80 engage the rafter front end blocks 60 in a close fit. The rotatable roof panel locking means 62 are substantially prismatic members of a longer length than the width of slots 81. Roof panel locking means 62 selectively bear against the facer board 80 when rotated.

Rafter cross beam 70 is substantially an elongated rectangular plank member 71 having its wide portion disposed horizontally. Cross beam end blocks 72 are integrally formed or fixedly attached at the respective ends of the plank member 71. Cross beam panel supports 73 are fixedly attached to the lower horizontal face of the plank member 71 to provide means for rigid support of the roof panels 90 and wall panels 33. FIG. 4 illustrates an alternative embodiment of the rafter cross beam 70 that includes cross beam locking means 79, however, the structure of the cross beam panel supports 73 can be best seen by referring to FIG. 4. Panel supports 73 include an L-shaped member 74 disposed in spaced relationship below the plank member 71 by means of a panel support spacer 75 having the toe portion 76 of the L-shaped member 74 oriented downwardly. The panel support spacer 75 is flush with the rearward side of the plank member 71 and extends a shorter distance forwardly than the L-shaped member 74 and thereby forms a slot 77 between the plank member 71 and the L-shaped member 74. A roof panel 90 can therefore engage the slot 77 formed therein bearing on the upwardly disposed face 78 of the L-shaped member 74. A wall panel 33 bears against the toe portion 76 of the L-shaped member 74.

As previously mentioned, the rafter cross beam 70 illustrated in FIG. 4 includes cross beam locking means 79. Cross beam locking means 79 is a prismatic member having a rectangular cross-section and is rotatably attached to a locking means spacer **79*a* below the head of the L-shaped member 74. Cross beam locking means 79 is preferably attached by a screw means 100 which extends through the locking means 79, the locking means spacer 79*a* to the head of the L-shaped member 74**.

ASSEMBLY AND DISMANTLING

Reference is now directed to FIGS. 1–6 for the various components of the knock down structure 1 of the present invention. To assemble the structure 1 the first base beams 11 and second base beams 12 are interlocked to form the rectangular base support for the structure 1. Corner uprights 31 and intermediate uprights 32 are then respectively fit into the first end cavities 21 and second end cavities 22 of the second base beams 12, and into the intermediate cavities 16, 23 of the first base beams 11 and the second base beams 12. Wall panels 33 are then disposed in the respective longitudinal grooves 34, 35 and 38, 39 of the corner uprights 31 and the intermediate uprights 32.

The preferred practice of the art of this invention is to put the components of the roof assembly 50 together before placing the roof on the uprights 31, 32. For assembly of the roof assembly 50 the rafters 1, 52, 53 are placed at the site in horizontal alignment with the intermediate rafter 53 between the respective end rafters 51 and 52. The rafter cross beam 70 is then placed in the cross beam notches 58 of the rafters 51, 52, 53. Roof panels 90 are then slidably engaged in the longitudinal grooves 63, 67 of the end rafters 51, 52 and the intermediate rafter 53 and pushed rearwardly until the roof panels 90 engage the rafter cross beam slots 77. The roof panel locking means 62 are then rotated into parallel alignment with the rafter front end blocks 60. The facer board 80 is then placed at the forward portion of the roof assembly 50 with the facer board slots 81 engaging the rafter front end blocks 60. The roof panel locking means 62 are then rotated to a horizontally-disposed position so that the ends of the roof panel locking means 62 bear in snug engagement with the forward face of the facer board 80 (FIG. 6).

Roof assembly 50 is then place on the upper end of the uprights 31, 32, the corner uprights 31 engaging the forward notches 64 and rearward notches 65 of the end rafters 51, 52 and the intermediate uprights 32 engaging the intermediate notches 66 of the end rafters 51, 52 and the forward notch 68 and rearward notch 69 of the intermediate rafter 53. Once so positioned, the cross beam locking means 79 are then rotated to engage the bottom face of the rafter rear end block 57.

To dismantle the structure 1 the above steps are repeated in reverse order.

The terms and expressions which are employed are used as terms of description; it is recognized, though, that various modifications are possible. For example, the corner uprights 31 may be formed with a slot disposed at the upper end of the uprights 31 on the inwardly face and cross beam locking means 79 may be positioned to be rotated into the upright slot and thereby lock the roof assembly 50 to the corner uprights 31. Similar locking means may be employed at the lower end of the uprights 31 to lock the base frame assembly 50 to the uprights 31. Such modifications of the preferred embodiment of the present invention are within the spirit and scope of the appended claims.

It is also understood the following claims are intended to cover all of the generic and specific features of the invention herein described and all statements of the scope of the invention which as a matter of language, might fall therebetween.

Having described certain forms of the invention in some detail, what is claimed is:

1. A knock down shelter and storage structure comprising a base frame assembly;

a vertical wall assembly; and a roof assembly;

said base frame assembly comprising a pair of first base beams and a pair of second base beams, each said first base beam being an elongated member including first end notches and second end notches transversely cut in the upper face of said first base beam and at least one intermediate cavity formed in the upper face of said first base beam between the respective end notches, said first base beam further including longitudinal grooves that extend from the said end notches to said at least one intermediate cavity thereinbetween; each said second base beam being a similarly-shaped elongated member having a first end notch and a second end notch transversely cut in the lower face of said second base beam, said second base beam further including a first end cavity, a second end cavity and one or a plurality of intermediate cavities formed in the upper face of said second base beam, said second base beam further including longitudinal grooves that extend between the respective second base beam end cavities and said at least one second base beam intermediate cavity said second base beam further including short transverse grooves formed in the upper face of said second base beam which extend from one side of the respective second base beam end cavities to a side edge of said second base beam at a right angle to the longitudinal grooves of said second base beam;

the end notches of one said second base beam engaging the first end notches of one said first base beam and the end notches of the other said second base beam engaging the second end notches of the other of said first base beam to form a rectangular base for said structure;

said vertical wall assembly comprising a plurality of vertically-extending corner uprights, a plurality of vertically-extending intermediate uprights, and a plurality of rectangular wall panels, said corner uprights respectively engaging said first and second end cavities of said second base beam at the lower end thereof, and engaging said roof assembly at the upper end thereof, said intermediate uprights respectively engaging said at least one intermediate cavity of said first base beams and said at least one intermediate cavity of said second base beams at the lower; end thereof and engaging said roof assembly at the upper end thereof, said corner uprights being elongated beams including a longitudinal groove extending the length of said corner upright in two adjacent faces disposed at right angles to each other, said intermediate uprights being elongated beams including a longitudinal groove extending the length of each said intermediate upright in opposing faces of said intermediate upright; said wall panels slidably engaging the longitudinal grooves of said corner uprights and said intermediate uprights, and the respective longitudinal grooves and transverse grooves of said first base beam and said second base beam.

2. The invention of claim 1 wherein at least one of said wall panels includes a door.

3. The invention of claim 2 wherein at least one of said wall panels includes a window.

4. The invention of claim 1 wherein said roof assembly includes a first end rafter, a second end rafter, at least one intermediate rafter; a rafter cross beam, said rafter cross beam transversely engaging the rearward ends of said first end rafter, a second rafter cross beam, said second rafter cross beam transversely engaging the forward ends of said second end rafter and said at least one intermediate rafter, a facer board, said facer board transversely engaging the forward ends of said first end rafter, said second end rafter and said intermediate rafters, and a plurality of rectangular roof panels slidably engaging said first end rafter, said second end rafter and said intermediate rafters.

5. The invention of claim 4 wherein said rafters are prismatic members having a top face that slopes downwardly from front to rear, vertically-extending side faces and a substantially flat bottom face, said rafters including a rafter rear end block integrally formed or fixedly attached at the rearward face of each said rafter, said rafters including a cross beam notch formed in the top face of each said rafter adjacent to the inward face of said end block for receipt of said cross beam in transverse engagement and a rafter front end block integrally formed or fixedly attached at the forward face of each said rafter for receipt of said facer board, said rafters further including roof panel locking means rotatably attached to the forward face of said rafter front end blocks.

6. The invention of claim 5 wherein said facer board is an elongated rectangular plank member having its wide portion disposed vertically and includes vertical slots disposed in its lower portion corresponding in number to the total number of rafters.

7. The invention of claim 5 wherein said roof panel locking means are prismatic members which selectively bear against said facer board.

8. The invention of claim 5 wherein said end rafters include a longitudinal groove extending along the inwardly-disposed side face of said end rafters at the same slope as the top face of said end rafters, said groove extending from the forward face of said end rafter to said cross beam notch, the bottom surface of said groove and the bottom surface of said cross beam notch being co-extensive, and said intermediate rafter includes paired longitudinal grooves extending along each side face of said intermediate rafter at the same slope as the top face of said intermediate rafter, the bottom surface of said grooves and the bottom surface of the cross beam notch of said intermediate rafter being co-extensive.

9. The invention of claim 5 wherein the bottom face of said end rafters includes an end rafter forward notch, an and rafter rearward notch and at least one end rafter intermediate notch, said at least one notch transversely cutting an inward portion of said end rafter bottom face, the upper end of said corner uprights engaging the respective forward notches and rearward notches of said end rafters, and the upper end of said intermediate uprights engaging said end rafter's at least one intermediate, and the bottom face of said intermediate rafters includes forward and rearward notches that transversely cut completely across the bottom face of said at least one intermediate rafter.

10. The invention of claim 9 further including cross beam locking means comprising a prismatic member having a rectangular cross-section and being rotatably attached to a locking means spacer below the head of said L-shaped member.

11. The invention of claim 10 wherein said corner uprights are formed having a slot disposed at the upper end thereof and said cross beam locking means are positioned in a manner to be selectively rotatable into said slot formed in said corner uprights and thereby lock said roof assembly to said corner uprights.

12. The invention of claim 4 wherein said rafter cross beam is an elongated rectangular plank member having its wide portion disposed horizontally, cross beam end blocks being integrally formed or fixedly attached at the respective ends of said plank member and cross beam panel supports being fixedly attached to the lower horizontal face of said plank member to provide means for rigid support of said roof panels and said wall panels.

13. The invention of claim 12 wherein said cross beam panel supports include an L-shaped member disposed having the toe portion of said L-shaped member oriented downwardly and being disposed in spaced relationship below said plank member by means of a panel support spacer, said panel support spacer being flush with the rearward side of said plank member and extending a shorter distance forwardly than said L-shaped member and thereby forming a slot between said plank member and said L-shaped member for receipt of said roof panel, a wall panel bearing on the toe portion of said L-shaped member.

14. The invention of claim 1 wherein said first base beam is formed having a substantially rectangular cross-section, said end cavities and said intermediate cavities are respectively formed having a rectangular shape, said corner uprights are formed having a rectangular cross-section and said intermediate uprights are formed having a rectangular cross-section.

* * * * *